US009705266B2

(12) United States Patent
Chen et al.

(10) Patent No.: US 9,705,266 B2
(45) Date of Patent: Jul. 11, 2017

(54) CABLE CONNECTOR AND CONDUCTIVE TERMINAL THEREOF

(71) Applicant: COOLER MASTER TECHNOLOGY INC., New Taipei (TW)

(72) Inventors: Chun-Lin Chen, New Taipei (TW); Chih-Min Chang, New Taipei (TW)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 0 days.

(21) Appl. No.: 14/835,702

(22) Filed: Aug. 25, 2015

(65) Prior Publication Data

US 2017/0005431 A1 Jan. 5, 2017

(30) Foreign Application Priority Data

Jul. 1, 2015 (TW) ..... 104210616 U

(51) Int. Cl.

| | |
|---|---|
| ***H01R 24/28*** | (2011.01) |
| ***H01R 11/09*** | (2006.01) |
| *H01R 13/52* | (2006.01) |
| *H01R 13/64* | (2006.01) |
| *H01R 101/00* | (2006.01) |

(52) U.S. Cl.

CPC ..... *H01R 24/28* (2013.01); *H01R 11/09* (2013.01); *H01R 13/521* (2013.01); *H01R 13/64* (2013.01); *H01R 2101/00* (2013.01)

(58) Field of Classification Search

CPC H01R 13/5205; H01R 13/5221; H01R 23/02; H01R 43/24; Y10S 439/942

USPC ..... 439/587, 606, 660

See application file for complete search history.

(56) References Cited

U.S. PATENT DOCUMENTS

| | | | | | |
|---|---|---|---|---|---|
| 4,005,922 | A * | 2/1977 | Burkhart | H01R 13/512 | 439/465 |
| 4,512,619 | A * | 4/1985 | Dechelette | H01R 9/053 | 439/276 |
| 4,812,129 | A * | 3/1989 | Rofer | H01R 12/716 | 439/79 |
| 5,295,871 | A * | 3/1994 | Lapraik | H01R 13/432 | 439/746 |
| 5,855,493 | A * | 1/1999 | Shelly | H01R 13/516 | 439/465 |
| 6,083,053 | A * | 7/2000 | Anderson, Jr. | H01R 23/27 | 439/652 |

(Continued)

*Primary Examiner* — Tulsidas C Patel
*Assistant Examiner* — Travis Chambers
(74) *Attorney, Agent, or Firm* — Maschoff Brennan

(57) ABSTRACT

A cable connector includes a metal housing, conductive terminals, and contact members. The metal housing includes a first end and a second end opposite to the first end. An accommodation space is formed for communicating with the first end and the second end. The conductive terminals are configured to clamp cables, and each conductive terminal includes a clamp portion, a containing portion, and an engaging portion. The clamp portion and the engaging portion are disposed at two ends of the containing portion, respectively. At least one slot is formed on the engaging portion. Each contact member passes through the accommodation space from the first end and is inserted into the engaging portion. An outside surface of the contact member contacts an inner surface of the engaging portion by making surface-to-surface contact, thereby reducing a resistance value to permit efficient power transmission.

13 Claims, 5 Drawing Sheets

(56) References Cited

U.S. PATENT DOCUMENTS 6,089,880 A * 7/2000 Miyagawa ..... H01R 13/11 439/741
6,247,978 B1 * 6/2001 Wu ..... H01R 13/432 439/687
6,250,961 B1 * 6/2001 Boiret ..... H01R 13/523 439/587
6,447,337 B1 * 9/2002 Anderson ..... H01R 13/719 439/607.07
6,814,625 B2 * 11/2004 Richmond ..... H01R 13/6453 439/157
6,824,427 B1 * 11/2004 Feldman ..... G01R 31/2887 439/578
7,066,757 B1 * 6/2006 Rengifo ..... H01R 13/111 439/332
7,413,478 B2 * 8/2008 Kleinschmidt ..... H01R 4/64 439/686
7,722,416 B2 * 5/2010 Gump ..... H01R 4/188 439/879
7,959,454 B2 * 6/2011 Ramasubramanian H01R 13/03 439/201
8,277,249 B2 * 10/2012 Koga ..... H01R 4/185 29/867
8,360,807 B2 * 1/2013 Buff ..... H01R 13/6315 439/581
8,834,201 B2 * 9/2014 Miyawaki ..... H01R 4/184 439/585
8,858,264 B2 * 10/2014 Mott ..... H01R 4/28 439/660
2015/0222049 A1 * 8/2015 Armacost ..... B60D 1/64 439/312
2015/0370029 A1 * 12/2015 Petersen ..... G02B 6/4471 385/114
2015/0380863 A1 * 12/2015 Uchida ..... H01R 4/185 439/587

* cited by examiner

CABLE CONNECTOR AND CONDUCTIVE TERMINAL THEREOF

TECHNICAL FIELD

The present invention relates to a connector and a conductive terminal thereof and, in particular, to a cable connector and a conductive terminal thereof, which effectively reduces a resistance value.

BACKGROUND

At present, in a desktop computer case, there are many sockets for insertion of various computer components. A power supply device, a motherboard, a hard disk are installed in the computer case. After installing the aforesaid components, a power output line of the power supply device is connected to each of the aforesaid computer components to supply power. Since a large-power (wattage) power supply device can connect more components, the power supply device has more power output lines, and as a result, the lines in the computer case are often in disorder.

At present, there is a modular arrangement manner for the power lines of the power supply device, in which many sockets are disposed on a housing of the power supply device. According to requirements of consumers, standardized power cables are connected to the sockets of the power supply device and the peripheral components to make an electrical insertion connection. By doing so, unnecessary power lines which are not in use can be removed and put away. When the consumers would like to install more peripheral components in the computer case, they can adjust the power lines by themselves according to their requirements and insert the required power lines into the sockets of the power supply device, thereby solving the disorder problem of the power lines.

However, a male-female connection structure of a conventional cable connector makes connections by making point-to-point contact. In other words, an outer surface of a plug has at least two protruding points in contact with a protruding portion of an inner surface of the socket, thereby making point-to-point contact. This conventional insertion connection has an insufficient contact area, so a resistance value is increased every now and then, thereby causing an increase in temperature, which may damage the connector.

Accordingly, the inventor aims to overcome the above-mentioned problems of the conventional cable connector, on the basis of which the present invention is accomplished.

SUMMARY

It is an object of the present invention to provide a cable connector and a conductive terminal thereof, which reduces a resistance value and permits efficient power transmission by making surface-to-surface contact.

Accordingly, the present invention provides a cable connector connected with a plurality of cables. The cable connector comprises a metal housing, a plurality of conductive terminals and a plurality of contact members. The metal housing includes a first end and a second end opposite to the first end. An accommodation space is formed for communicating with the first end and the second end. The conductive terminals clamp the cables, respectively. Each of the conductive terminals clamps a respective one of the cables and includes a clamp portion, a containing portion, and an engaging portion. The clamp portion and the engaging portion are disposed at two ends of the containing portion respectively. At least one slot is formed on the engaging portion. Each of the contact members passes through the accommodation space from the first end and is inserted into a respective one of the engaging portions. At least a portion of an outside surface of each of the contact members is in surface-to-surface contact with an inner surface of the respective one of the engaging portions.

It is preferable that the cable connector further comprises a wire-fixing block accommodated in the second end, each of two sides of the wire-fixing block includes a plurality of barriers, and a positioning trench is formed between each two adjacent barriers for positioning the conductive terminal.

It is preferable that the metal housing includes a stop wall, and the cable connector further comprises a waterproof washer disposed adjacent to the wire-fixing block and in contact against the stop wall. The waterproof washer is provided with at least one through hole, and the conductive terminal passes through the through hole.

It is preferable that the cable connector further comprises an insulation covering, the insulation covering includes a bottom, and the second end and the wire-fixing block are in contact with the bottom. The containing portion further includes two barb portions and two bumps, the waterproof washer is in contact with one end of the barb portion, and the wire-fixing block is disposed between the waterproof washer and the bottom.

It is preferable that the second end includes an engagement hole, and an end face of each of at least one of the barriers is disposed with an engagement point for engaged with the engagement hole.

In another broad embodiment, the present invention further provides a conductive terminal connected with at least one cable. The conductive terminal comprises a containing portion, a clamp portion, an enclosing portion, and an engaging portion. The clamp portion is connected to one side of the containing portion and includes at least one protrusion for clamping the cable. The enclosing portion is connected to the clamp portion and includes two extension arms for fastening a respective one of the cables. The engaging portion is connected to the other side of the containing portion, and the engaging portion includes at least one slot.

It is preferable that the containing portion further includes two barb portions close to the engaging portion and includes two bumps close to the clamp portion. The two barb portions are symmetrically disposed with respect to each other and the two bumps are symmetrically disposed with respect to each other.

It is preferable that a diameter of the containing portion is greater than or equal to a diameter of the engaging portion. At least one slot extends from one side of the containing portion to an end edge of the engaging portion.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
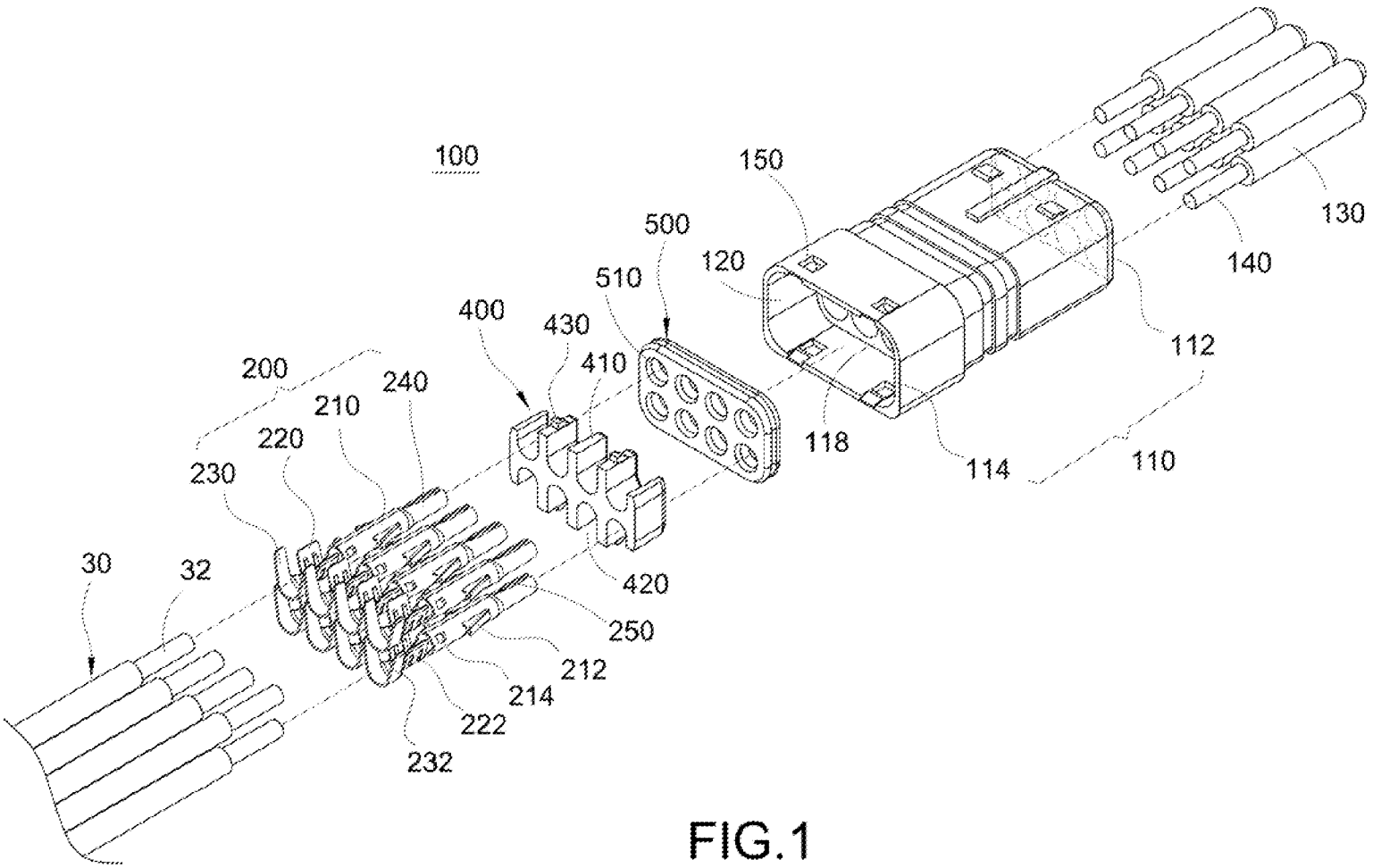
FIG. 1 is an exploded view of the cable connector of the present invention.
Figure 2:
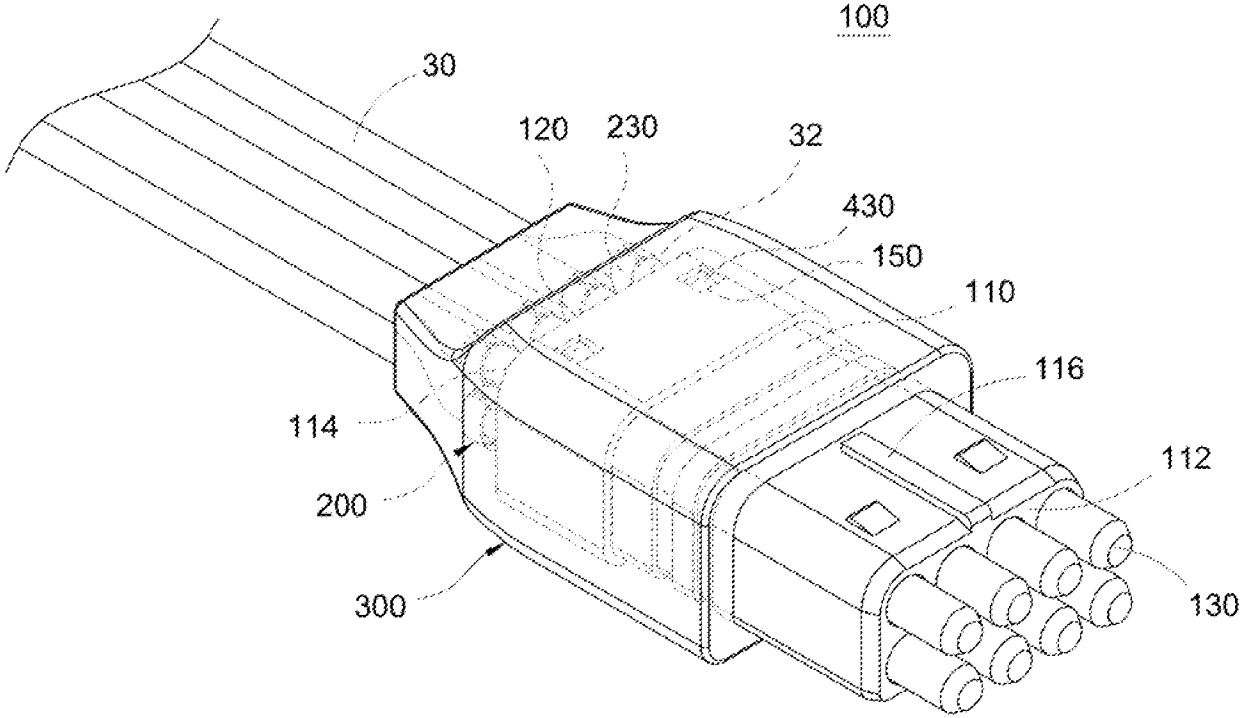
FIG. 2 is a perspective view of the cable connector of the present invention.

Referring to FIGS. 1 to 4, the present invention provides a cable connector 100 (i.e. a male part) connected with a plurality of cables 30 and electrically connected to a socket 20 (i.e. a female part) of a power supply device 10. Referring to FIGS. 1 and 2, the cable connector 100 includes a metal housing 110, a plurality of conductive terminals 200, and a plurality of contact members 130. The metal housing 110 includes a first end 112 and a second end 114 opposite to the first end 112. An accommodation space 120 is formed for communicating with the first end 112 and the second end 114. The metal housing 110 further includes a foolproof portion 116 and a plurality of engagement holes 150 on the second end 114.

Figure 3:
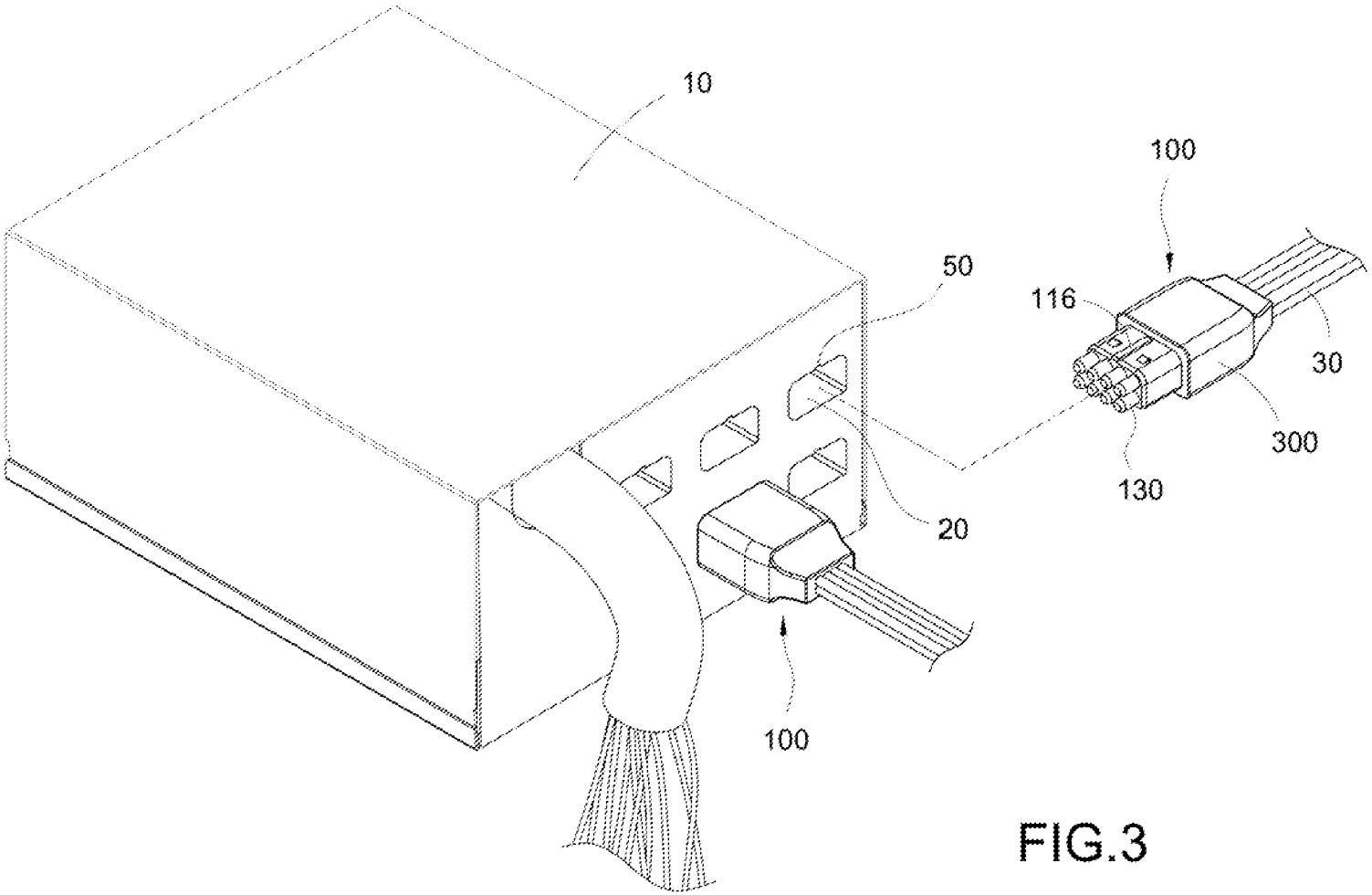
FIG. 3 is a schematic view illustrating the cable connector inserted into a socket according to one embodiment of the present invention.

Referring to FIG. 3, it is preferable that the foolproof portion 116 is protrudingly disposed on an outer surface of the first end 112. The socket 20 is provided with a joint portion 50 corresponding to the foolproof portion 116. In other words, the protruding foolproof portion 116 is inserted into the joint portion 50 concavely disposed in the socket 20. However, in other different embodiments, the foolproof portion 116 and the joint portion 50 have complementary shapes which are interchangeable. Therefore, the foolproof portion 116 and the joint portion 50 can prevent incorrect insertion (i.e. providing foolproof protection).

Each of the conductive terminals 200 clamps a respective one of the cables 30. At least one of the conductive terminals 200 includes a containing portion 210, a clamp portion 220, and an engaging portion 240. The clamp portion 220 and the engaging portion 240 are disposed at two ends of the containing portion 210 respectively. At least one slot 250 is formed on the engaging portion 240. At least one of the contact members 130 passes through the accommodation space 120 from the first end 112 and is inserted into the engaging portion 240. At least a portion of an outside surface of the at least one of the contact members 130 is in surface-to-surface contact with an inner surface of a respective one of the engaging portions 240.

The at least one of the contact members 130 further includes a root portion 140. The root portion 140 is inserted in a respective one of the engaging portions 240, and a portion of the at least one of the contact members 130 protrudes out of the first end 112. As shown in FIG. 1, a diameter of the root portion 140 is greater than or equal to a diameter of the corresponding engaging portion 240 in which the root portion is inserted, so that an outer surface of the root portion 140 is in surface-to-surface contact with an inner surface of the corresponding engaging portion 240. Furthermore, the containing portion 210 and the engaging portion 240 are circular, the root portion 140 of the contact member 130 is of cylindrical shape, and the outer surface of the root portion 140 of the contact member 130 is in surface-to-surface contact with the inner surface of the engaging portion 240. By utilizing the at least one slot 250, the engaging portion 240 has a certain flexibility when contacting the root portion 140. Therefore, the present invention effectively reduces a resistance value and permits efficient and smooth power transmission by making surface-to-surface contact.

As shown in the figures, the present embodiment further includes an insulation covering 300, the insulation covering 300 encloses the metal housing 110 from the second end 114 to the first end 112 and exposes a portion of the first end 112 to facilitate taking, plugging or unplugging the cable connector 100 by a user, and meanwhile providing an insulation effect.

Figure 4:
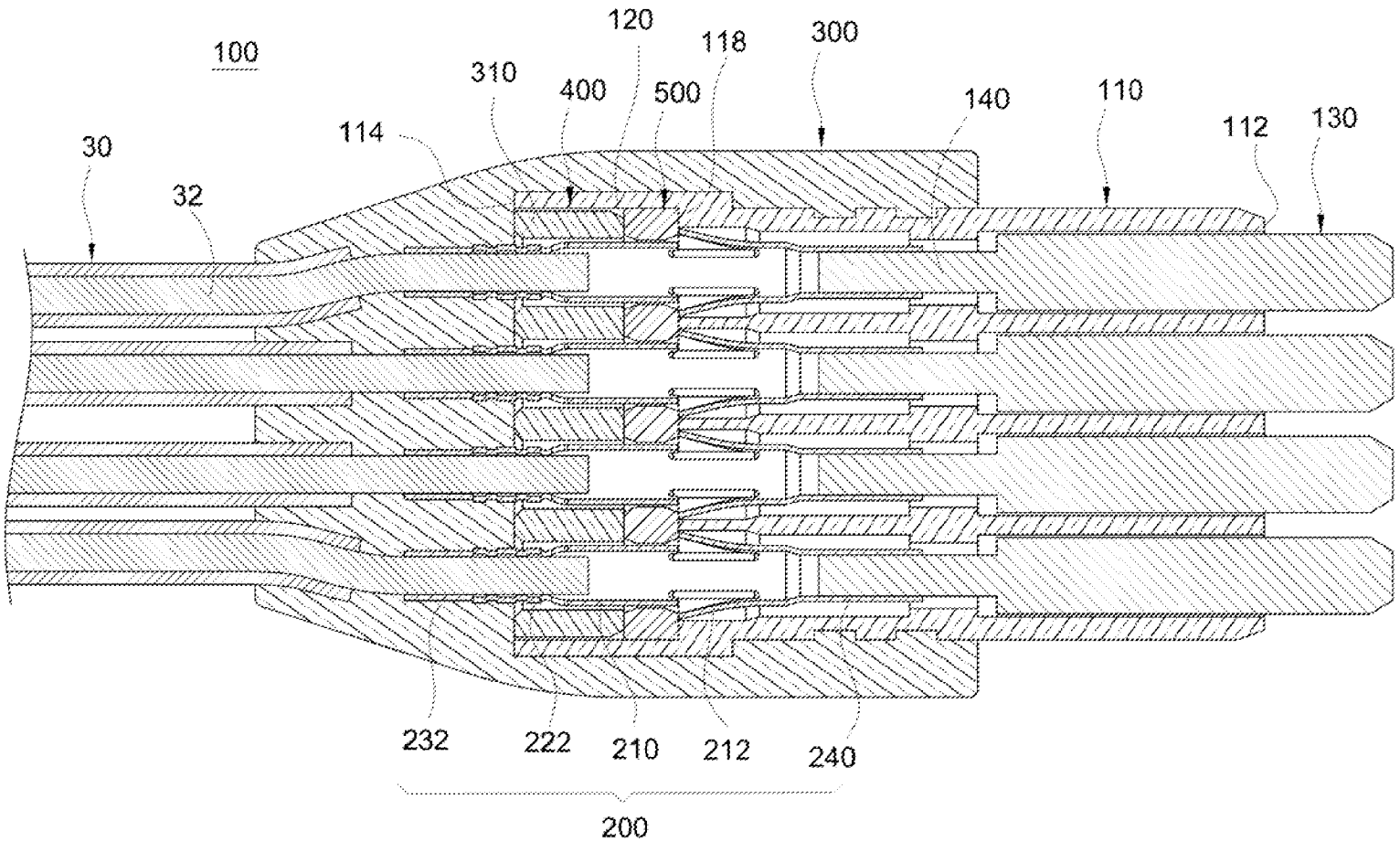
FIG. 4 is a cross-sectional view of the cable connector of the present invention.

As shown in the embodiment of FIG. 1 and FIG. 4, the conductive terminal 200 further includes an enclosing portion 230 connected to the clamp portion 220. At least one of the clamp portions 220 clamps a cable core 32 of one of the cables 30. The enclosing portion 230 includes two extension arms 232 for fastening the cable core 32 of one of the cables 30. A diameter of the containing portion 210 is greater than or equal to a diameter of the engaging portion 240. At least one protrusion 222 protrudes from a surface of the clamp portion 220. The protrusion 222 can enhance fastening the cable core 32 of the cable 30.

In the present embodiment, the cable connector 100 further includes a wire-fixing block 400 accommodated in the second end 114 and a waterproof washer 500 disposed adjacent to the wire-fixing block 400. Each of two sides of the wire-fixing block 400 includes a plurality of barriers 410. A positioning trench 420 is formed between at least two adjacent barriers 410 for positioning a respective one of the conductive terminals 210. According to the embodiment shown in FIGS. 1 and 2, an end face of a portion of the barriers 410 is disposed with an engagement point 430 for engaged with the engagement hole 150 of the metal housing 110, so that the conductive terminals 200 can be firmly secured to the metal housing 110 by means of the wire-fixing block 400.

Moreover, referring to FIG. 4, the metal housing 110 includes a stop wall 118 therein for making contact against the waterproof washer 500. The wire-fixing block 400 is disposed between the waterproof washer 500 and the bottom 310. The containing portion 210 further includes two barb portions 212 and two bumps 214. The two barb portions 212 are disposed close to the engaging portion 240 relative to the two bumps 214. One end of each of the two barb portions 212 is in contact against the waterproof washer 500. The waterproof washer 500 is provided with a plurality of through holes 510 for insertion of the conductive terminals 200. The two bumps 214 are disposed close to the clamp portion 220 relative to the two barb portions 212 for fastening the wire-fixing block 400.

Figure 5:
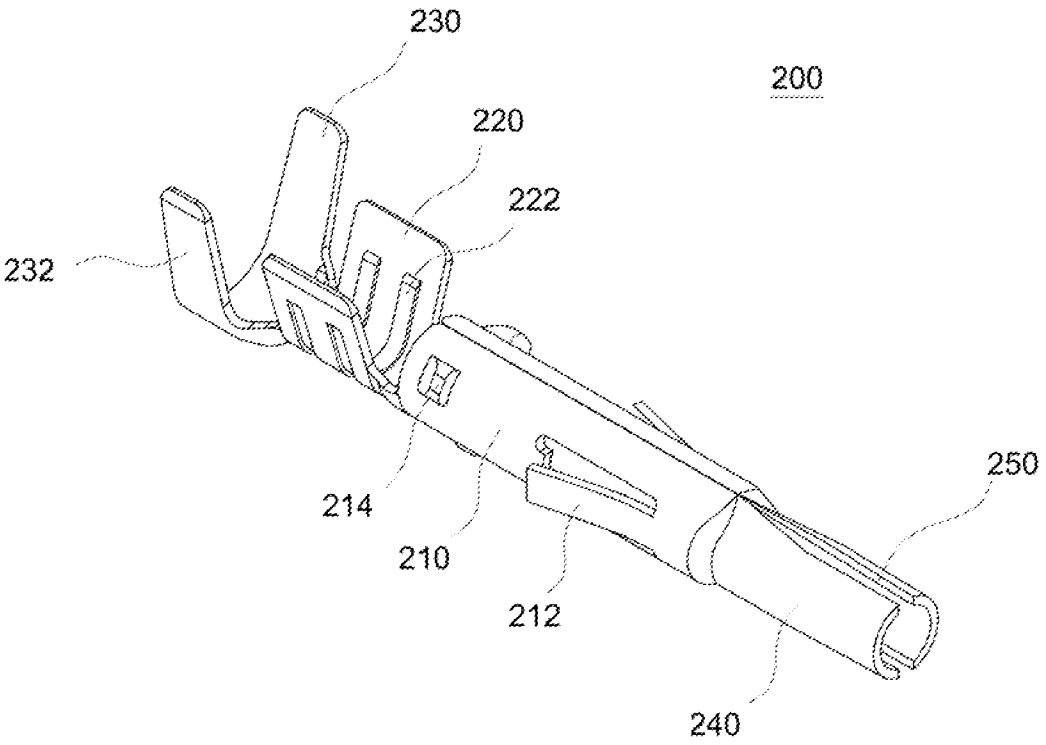
FIG. 5 is a perspective view of the conductive terminal of the present invention.

Referring to FIG. 5, in another broad embodiment, the present invention further provides a conductive terminal 200 which comprises a containing portion 210, a clamp portion 220, an enclosing portion 230, and an engaging portion 240. The clamp portion 220 is connected to one side of the containing portion 210 and includes at least one protrusion 222 for clamping a respective one of the cables 30. The enclosing portion 230 is connected to the clamp portion 220 and includes two extension arms 232 for fastening each of the cables 30. The engaging portion 240 is connected to the other side of the containing portion 210, and the engaging portion 240 includes at least one slot 250.

In the present embodiment, the containing portion 210 and the engaging portion 240 are preferably of circular cross section. The containing portion 210 further includes two barb portions 212 close to the engaging portion 240 and includes two bumps 214 close to the clamp portion 220. It is preferable that the two barb portions 212 are symmetrically disposed with respect to each other, and the two bumps 214 are symmetrically disposed with respect to each other. It is preferable that a diameter of the containing portion 210 is greater than a diameter of the engaging portion 240. However, in other embodiments, the diameter of the containing portion 210 can also be equal to the diameter of the engaging portion 240.

Furthermore, the slot 250 preferably extends from one side of the containing portion 210 to an end edge of the engaging portion 240. There are preferably two slots 250 symmetrically disposed at two sides of the engaging portion 240 so as to provide a certain flexibility for the contact member (not illustrated) inserted therein. Both of the enclosing portion 230 and the clamp portion 220 are able to clamp the cable core 32 of the cable 30, so that the power can be transmitted to each of the contact members 130.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A cable connector, adapted for connecting a cable, the cable connector comprising:

a metal housing having a first end and a second end opposite to the first end, an accommodation space being formed for communicating with the first end and the second end;

at least one conductive terminal for clamping the cable, the conductive terminal having a containing portion and an engaging portion, the engaging portion being directly in contact with one end of the containing portion, wherein at least one slot is formed on the engaging portion;

at least one contact member, passing through the accommodation space from the first end and inserted into the engaging portion, wherein at least a portion of an outside surface of the contact member is in surface-to-surface contact with an inner surface of the engaging portion; and a wire-fixing block received in the second end, wherein the containing portion is partially disposed inside the wire-fixing block, and the engaging portion is fully disposed outside of the wire-fixing block.

2. The cable connector of claim 1, wherein the conductive terminal further includes a clamp portion and an enclosing portion connected to the clamp portion, wherein the clamp portion is disposed at the other end of the containing portion opposite to the engaging portion and is partially disposed inside the wire-fixing block, and the enclosing portion includes two extension arms for fastening a cable core of the cable.

3. The cable connector of claim 1, wherein a diameter of the containing portion is greater than or equal to a diameter of the engaging portion, and at least one protrusion protrudes from a surface of the clamp portion.

4. The cable connector of claim 1, wherein a foolproof portion is disposed on an outer surface of the first end.

5. The cable connector of claim 1, wherein the containing portion and the engaging portion are circular, and the contact member is of cylindrical shape.

6. The cable connector of claim 1, wherein the each of two sides of the wire-fixing block includes a plurality of barriers, a positioning trench is formed between two adjacent barriers for positioning the conductive terminal.

7. The cable connector of claim 6, further comprising an insulation covering, wherein the insulation covering includes a bottom, and the second end and the wire-fixing block are in contact with the bottom.

8. The cable connector of claim 6, wherein the metal housing includes a stop wall therein, and the cable connector further comprising:

a waterproof washer disposed adjacent to the wire-fixing block and in contact against the stop wall, the waterproof washer being provided with at least one through hole, the conductive terminal passing through the through hole.

9. The cable connector of claim 8, wherein the second end includes an engagement hole, and an end face of at least one of the barriers is disposed with an engagement point for engaged with the engagement hole.

10. The cable connector of claim 8, wherein the containing portion further includes at least one pair of barb portions and bumps, the waterproof washer is in contact with one end of the barb portion, and the wire-fixing block is disposed between the waterproof washer and the bottom.

11. The cable connector of claim 1, wherein at least one of the contact members further includes a root portion, the root portion is inserted in the engaging portion, and at least one of the contact members protrudes out of the metal housing from the first end.

12. The cable connector of claim 11, wherein a diameter of the root portion is greater than or equal to a diameter of the engaging portion.

13. A cable connector, adapted for connecting a cable, the cable connector comprising:

a metal housing having a first end and a second end opposite to the first end, an accommodation space being formed for communicating with the first end and the second end;

at least one conductive terminal for clamping the cable, the conductive terminal having a containing portion and an engaging portion, the engaging portion being disposed at one end of the containing portion respectively, wherein at least one slot is formed on the engaging portion;

at least one contact member, passing through the accommodation space from the first end and inserted into the engaging portion, wherein at least a portion of an outside surface of the contact member is in surface-to-surface contact with an inner surface of the engaging portion;

a wire-fixing block received in the second end, each of two sides of the wire-fixing block including a plurality of barriers, a positioning trench being formed between two adjacent barriers for positioning the conductive terminal, and an insulation covering, wherein the insulation covering includes a bottom, and the second end and the wire-fixing block are in contact with the bottom.

* * * * *